United States Patent [19]

Hartwig

[11] 4,026,575

[45] May 31, 1977

[54] PLASTIC SKI

[75] Inventor: Peter Rudolf Hartwig, Hilchenbach, Germany

[73] Assignee: Schloemann-Siemag Aktiengesellschaft, Dusseldorf, Germany

[22] Filed: Dec. 8, 1975

[21] Appl. No.: 638,536

[30] Foreign Application Priority Data

Dec. 24, 1974 Germany ..... 2461461

[52] U.S. Cl. ..... 280/610

[51] Int. Cl.[2] ..... A63C 5/07

[58] Field of Search ..... 280/610, 601, 609

[56] References Cited

UNITED STATES PATENTS

| | | | |
|---|---|---|---|
| 2,213,903 | 9/1940 | Davidson | 280/610 |
| 2,995,379 | 8/1961 | Head | 280/610 |
| 3,493,240 | 2/1970 | Jenks | 280/610 |
| 3,498,626 | 3/1970 | Sullivan | 280/610 |
| 3,503,621 | 3/1970 | Schmidt et al. | 280/610 |
| 3,733,380 | 5/1973 | Ishida | 280/610 |
| 3,771,805 | 11/1973 | Ishida | 280/610 |

*Primary Examiner*—Joseph F. Peters, Jr.
*Assistant Examiner*—David M. Mitchell
*Attorney, Agent, or Firm*—Norman S. Blodgett; Gerry A. Blodgett

[57] ABSTRACT

Plastic ski of compound structure consisting of a running surface with steel edges, a lower strap, an upper strap, and a cover layer, the upper and the lower straps being connected to each other by an injected core of plastic foam.

4 Claims, 4 Drawing Figures

PLASTIC SKI

BACKGROUND OF THE INVENTION

Compound skis are known, which are formed from prefabricated parts. These prefabricated parts are, for example, the running surface with steel edges, upper and lower straps made from epoxy-fiber glass or aluminum lamina, a core of wood or foamed thermo- or duro-plast-polyurethane, aluminum edges, protection for the side areas as well as for the end and tip. These parts are inserted into a molding press by positioning special glue and anchoring parts between them and are connected with each other by pressure and heat. By this method, skis of any length may be fabricated which fulfill any requirements. The disadvantage of such a ski is that its fabrication is time-consuming and very costly. In one known plastic ski the prefabricated parts are joined in one working operation by use of a polyurethane-duromer-hard foam. The prefabricated parts, such as steel edges, running surface, tip and end protection, and upper and lower straps, are placed in a foam mold and the mold cover is closed over it. The remaining hollow space for the ski core is filled with polyurethane-duromer-hard foam, the raw material being injected into the hollow space in liquid form and is foamed at that time. After the foam hardens, the finished ski may be removed. Through the adhesive action of the polyurethane-duromer-hard foam, the prefabricated parts of the ski are tightly connected. Such a ski can be easily fabricated; no special fabrication of the ski core is necessary and special glue and a special press can be eliminated. Such a ski, however, has the disadvantage that it can resist only limited loads because of the limited stress properties of the core made from polyurethane-duromer-hard foam. Defects appear especially within the high-stress portions of the ski tip and the ski end in such a way that the upper and lower straps used for achieving bend stiffening become loosened from the ski core or the ski breaks. Since there is a correlation between the weight of the skier and the length of the ski, this ski cannot be used for adults. Such skis are presently made only up to a length of 175 cm (5-10), i.e., for youth. These and other difficulties experienced with the prior art devices have been obviated in a novel manner by the present invention.

It is, therefore, an outstanding object of the invention to provide a plastic ski of the compound structure which can be readily produced, does not require a special fabrication of the ski core, and is made without special adhesive or a special press.

With this and other objects in view, as will be apparent to those skilled in the art, the invention resides in the combination of parts set forth in the specification and covered by the claims appended hereto.

SUMMARY OF THE INVENTION

In general, the invention consists of a plastic ski in which the core is made with its length having at least three sections formed from at least two plastic foam masses which differ in density; the center section of the core is of a lower density than the end areas. Such a ski has a correspondingly low weight, its center portion enjoys a high compressive strength, and its end portions (ski tip and ski end) have the necessary bending stress. The ski may be fabricated in a mold designed to be correspondingly simple.

The density of the core in the end portions is approximately twice that of the center portion; in the center portion the density is 0.3 to 0.6 gram per cc and in the end portions 0.8 to 1.1 gram per cc. The center portion of the core is formed of polyurethane-duromer-hard foam and the end portions of the core are formed of an elastic polyurethane-integral foam. In order to achieve a separation of the individual sections with their different densities during the injection operation, the individual areas of the core are connected with each other by an obstruction formed of fiber glass.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 3:
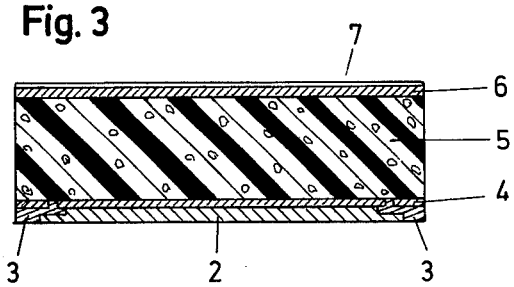
FIG. 3 is a transverse sectional view of the ski taken on the line III—III in FIG. 2.
Figure 4:
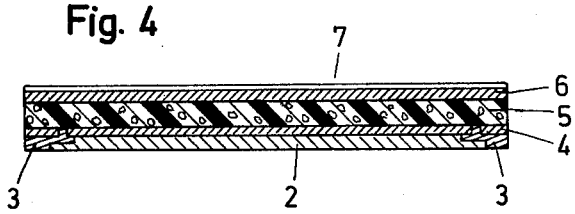
FIG. 4 is a transverse sectional view of the ski taken on the line IV—IV of FIG. 2

As shown in FIGS. 3 and 4, the ski 1 consists in the preferred embodiment of a running surface 2 with steel edges 3 arranged lengthwise along the sides, a carrying lower strap 4 made of a fiber glass lamina, a core 5 formed of polyurethane foam, an upper strap 6 made of a fiber glass lamina, and a cover layer 7.

Figure 1:
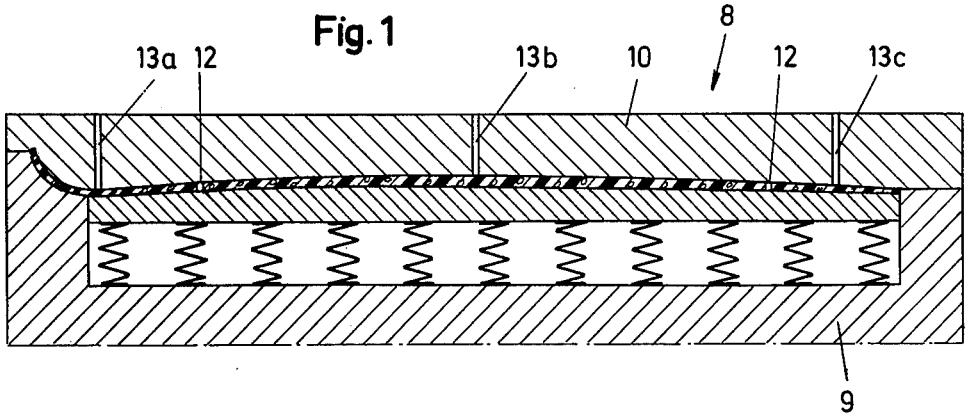
FIG. 1 shows a vertical sectional view of a foam mold for constructing a ski in accordance with the invention.
Figure 2:
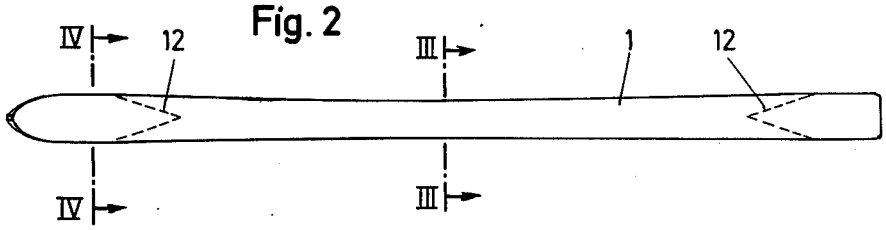
FIG. 2 is a plan view of the ski.

Referring to FIG. 1, a well-known foam mold 8 is used for the fabrication of such a designed ski 1. It consists of a lower mold part 9 and a mold cover 10; between them is formed a mold cavity 11. Into the open mold 8, particularly the open mold cavity 11, is first positioned the prefabricated running surface 2 along with the steel edges 3. To the running surface 2 is attached the layer or strap 4 of fiber glass lamina. By means of spacers, not shown in the drawing, in another layer 6 made from fiber glass lamina is arranged a distance above the layer 4, so that a hollow space is available between the two layers 4 and 6, for the core 5. In this embodiment, at a distance from the front and from the rear end of the ski 1, an obstruction layer 12 is positioned transversely; it is wedge shaped and consists of a fiber glass lamina, so that the hollow space for forming the core is divided lengthwise into three sections. Over the layer 6 is then placed the cover layer 7 which is only present for visual improvement of the ski 1.

After the top layer 7 has been placed in the mold cavity 11, the mold cover 10 is closed. The mold cover 10 is provided with three filler openings 13*a*, 13*b*, 13*c*, which enter the mold nest 11 laterally of the ski 1. With this arrangement, a filler opening 13*a*, 13*b*, 13*c* is provided for each closed-off portion of the core 5. Through the center filler opening 13*b* is now injected a raw material mixture in the liquid state for forming a polyurethane-duromer-hard foam in the center section of the hollow space and the material now is able to foam.

Through filler openings 13*a* and 13*c* is injected simultaneously (or with time delay) raw material in the liquid state for forming an elastic polyurethane-integral foam into the two end portions of the hollow space, which material also foams but to a much smaller extent.

Through the adhesive action of the polyurethane foam, the individual parts of the ski 1, which have been positioned in the mold 11, are tightly joined to each other. In the area of the fiber glass lamina layers there is formed a carrying lower strap 4 and a carrying upper strap 6. After the time for hardening has passed, the finished ski 1 may be removed.

This ski 1 now contains a foamed core 5 which has in its center section, as limited by both obstruction layers 12, a polyurethane-duromer-hard foam with a density in the range from 0.3 to 0.65 gr/ccm, and the two end areas of the core 5 are formed from an elastic polyurethane-integral foam of a density in the range from 0.8 to 1.1 gr/ccm.

By the use of different polyurethane foams for the ski core, whose properties may be adjusted and reproduced, an optimum of material may be used for each portion, that is to say, for each stress zone. By varying the properties of the foam material, and also by varying the individual sections of the core into which the raw material is injected for forming the different foams, all requirements required for a ski may be solved by this simple method.

In a variation of this described embodiment, it is also possible to replace the fiber glass straps by the well-known aluminum straps. Furthermore, it is possible to provide for the lower strap by direct use of the running surface and the steel edges. In the fabrication of the ski, tips and end protection devices may be inserted. Furthermore, it is possible to inject another foam into the front section of the ski, then into the end section. Naturally, it is also possible to dip the fiber glass straps into epoxy resin before they are positioned in the mold.

It is obvious that minor changes may be made in the form and construction of the invention without departing from the material spirit thereof. It is not, however, desired to confine the invention the exact form herein shown and described, but it is desired to include all such as properly come within the scope claimed.

The invention having been thus described, what is claimed as new and desired to secure by Letters Patent is:

1. Plastic ski of compound structure, consisting of a running surface with steel edges, a carrying strap, a carrying upper strap and a cover layer, whereby the upper and lower straps are connected by plastic foam which is injected into the core, characterized by the fact that the core (5) has at least three sections over its length and at least two different densities of plastic foam and the center section of the core (5) has a lower density than the two end sections, and that the individual sections of the core (5) are connected with each other by an obstruction (12) made of fiber glass.

2. Plastic ski as recited in claim 1, characterized by the fact that the density of the core (5) in the end sections is approximately twice that of the center section.

3. Plastice ski as recited in claim 1, characterized by the fact that the density of core (5) in the center section is in the range from 0.3 to 0.65 grams per cubic centimeter and in the end sections is in the range from 0.8 to 1.1 grams per cubic centimeter.

4. Plastic ski as recited in claim 1, characterized by the fact that the center section of the core is made from polyurethane-duromer-hard foam and the end sections are made from an elastic polyurethane-integral foam.

* * * * *